US005205418A

United States Patent [19]

Toschi

[11] Patent Number: 5,205,418

[45] Date of Patent: Apr. 27, 1993

[54] SCREEN FOR THE SIFTING OF MATERIALS OF DIFFERING WEIGHT

[75] Inventor: Angelo Toschi, Castellarano, Italy

[73] Assignee: Iperfin S.p.A., Italy

[21] Appl. No.: 782,836

[22] Filed: Oct. 24, 1991

[30] Foreign Application Priority Data

Oct. 24, 1990 [IT] Italy ..... 21862 A/90

[51] Int. Cl.[5] ..... B07C 5/16

[52] U.S. Cl. ..... 209/645; 209/239; 209/397

[58] Field of Search ..... 209/12, 44.1, 239, 372, 209/397, 512, 592, 655, 629, 634, 645, 650, 698, 611

[56] References Cited

U.S. PATENT DOCUMENTS

| | | | |
|---|---|---|---|
| 374,153 | 11/1887 | Hiatt | 209/649 |
| 1,082,612 | 12/1913 | Smith et al. | 209/397 X |
| 1,309,196 | 7/1919 | Haug | 209/650 X |
| 1,444,195 | 2/1923 | Lawry | 209/239 |
| 3,285,413 | 11/1966 | Taylor-Smith | 209/397 X |
| 3,494,708 | 2/1970 | Ito | 209/92 |
| 4,585,126 | 4/1986 | Paddock et al. | 209/698 X |

FOREIGN PATENT DOCUMENTS

| | | | |
|---|---|---|---|
| 0491488 | 1/1930 | Fed. Rep. of Germany . | |
| 0918968 | 8/1954 | Fed. Rep. of Germany | 209/645 |
| 2701307 | 5/1978 | Fed. Rep. of Germany . | |
| 8715942 | 1/1988 | Fed. Rep. of Germany . | |
| 2142580 | 2/1973 | France | 209/645 |
| 2384557 | 10/1978 | France . | |
| 2104228 | 3/1983 | United Kingdom | 209/645 |

OTHER PUBLICATIONS

World Patents Index Latest, SU 835,346 (Kiev Soyuzsortsemov), Jun. 7, 1981.

*Primary Examiner*—Robert P. Olszewski
*Assistant Examiner*—James R. Bidwell
*Attorney, Agent, or Firm*—Kirschstein, Ottinger Israel et al.

[57] ABSTRACT

Screen for the sifting of materials of differing weight, in which at least part of the screening orifices is covered by elastic diaphragms formed by lamellae.

17 Claims, 9 Drawing Sheets

SCREEN FOR THE SIFTING OF MATERIALS OF DIFFERING WEIGHT

BACKGROUND OF THE INVENTION

1. Field of the Invention

The above invention relates to a screen for the sifting of materials of differing weight.

The invention relates particularly to a screen for the grading of different materials which are contained, for example, in comminuted building rubble.

2. Description of Related Art

It is known to convey comminuted building rubble over screens or sifting devices, in order to obtain material accumulations with a defined maximum grain size. The material thus pregraded and sifted can be used as a substitute for natural aggregates, for example for making substrata, as a filler or for producing concrete mixtures of low strength.

The known sifters or plate-shaped vibrating screens with one or more sifting stations and with rotatably mounted sifters mostly consist of metal sheets or grids which are continuous or which are equipped with successive screening sections. These sections have sifting orifices of differing size. The larger orifices determine the maximum grain size both for the heavy rubble constituents (concrete particles, bricks, glass, tiles, pieces of marble) forming the actual natural aggregate substitutes and for the lighter materials (paper, cardboard, wood, plastic pieces) which constitute undesirable additives which reduce the quality of the recovered aggregates. To increase the quality of the recovered aggregates, it is necessary to reduce the fraction of light material as far as possible. This is possible, at the present time, only by manual sorting or by the use of special sifters which are operated by suction or flooding with water.

Manual sorting necessitates the constant presence of several assistants who perform their activity in an unhealthy environment with a high dust content. Sorting by suction effect requires the use of expensive devices, taking up a large amount of space, for generating the necessary vacuum and for separating the large quantities of dust sucked up. With such devices, moreover, the power consumption is very high. The discharge of the light materials as a result of their floatability in a water bath also makes it necessary to employ very bulky and expensive devices for the circulation of the water bath; a very large quantity of water, which is not always available, is needed. The separation of the lighter constituents in a water bath also leads to problems of environmental protection, and a high power consumption is also required in order to operate a water bath.

A further disadvantage of the known sifting devices is that it is not possible to make the screening orifices larger to any desired extent, as would be the case, for example, when heavy pieces of rubble of increasing grain size were to be sifted, without thereby having to allow for an undesirable increase of larger light constituents of the rubble in the screened-off fraction.

SUMMARY OF THE INVENTION

The object of the abovementioned invention is to provide a screening or sifting device of the said type, by means of which it is possible to carry out a grading of the heavy material and to separate the light material constituents from the quantity of rubble to be sifted, without an additional outlay in terms of energy or cost.

In the screening or sifting device provided, the object according to the invention is achieved in that at least part of the screening orifices are covered by elastically designed lamellar diaphragms.

The production of the lamellar diaphragms, which are to be laid over the screening or sifting orifices to be covered, constitute a simple and cost-effective solution, the diaphragms can be fastened to the screen or sifter in a simple way, and advantageously the diaphragms can also be incorporated in a canopy or covering of larger area made of elastic material.

Lamellar diaphragms with the best possible elasticity and operating reliability can be obtained by the use of flexible rubber layers joined together. Reliably working opening and closing operations of the lamellar diaphragm can be achieved and tears at the outer ends of the lamellae prevented if the lamellae of the diaphragms provided have slits which extend from the middle of the diaphragm to the outer edges of the screening orifices.

A grading out of the smaller pieces of rubble and a reduction of the diaphragm weight and therefore a shortening of the closing time of the lamellae become possible if a central orifice is made in the diaphragm.

Short closing times for the lamellae and an increase in the working speed of the screen or sifter will be achieved if the flexible lamellar coverings have a material thickness of between 6 and 12 mm, advantageously of 10 mm, and the central orifice of the diaphragm consisting of lamellae has a diameter of between 30 and 60 mm, advantageously of 50 mm.

The elasticity of the lamellae is influenced in an advantageous way in that the thickness of the material forming the lamellae of the diaphragm decreases continuously or stepwise from the outside of the diaphragm to the middle of the diaphragm.

The advantages affordable by the invention are principally that sifting takes place by the use of automatically adjusted orifices as a function of the weight of the pieces of rubble to be sifted, that is to say there is a sifting operation, organized according to different grain sizes, for heavy and for light materials, with the possibility of producing material accumulations which have only a few small pieces of light material. The result of this is that the aggregates for producing more profitable materials are available. Classification into different grain sizes is achieved, according to the invention, in that the elasticity of the lamellae of the orifices of the diaphragms is utilized in a suitable way. Thus, there is no need for grading operations which have hitherto had to be carried out by hand, and known devices for sifting by means of suction air or flushing with water can also be omitted. By means of the sifting devices designed according to the invention, an increase in the grain size for heavy pieces above the hitherto gradable values can be achieved, without this leading to a larger fraction and larger dimensions of the light material in the sifted product.

BRIEF DESCRIPTION OF THE DRAWINGS

The invention is now described in more detail and illustrated in the drawings with reference to an exemplary embodiment. In these.

DETAILED DESCRIPTION OF THE PREFERRED EMBODIMENT

Figure 1:
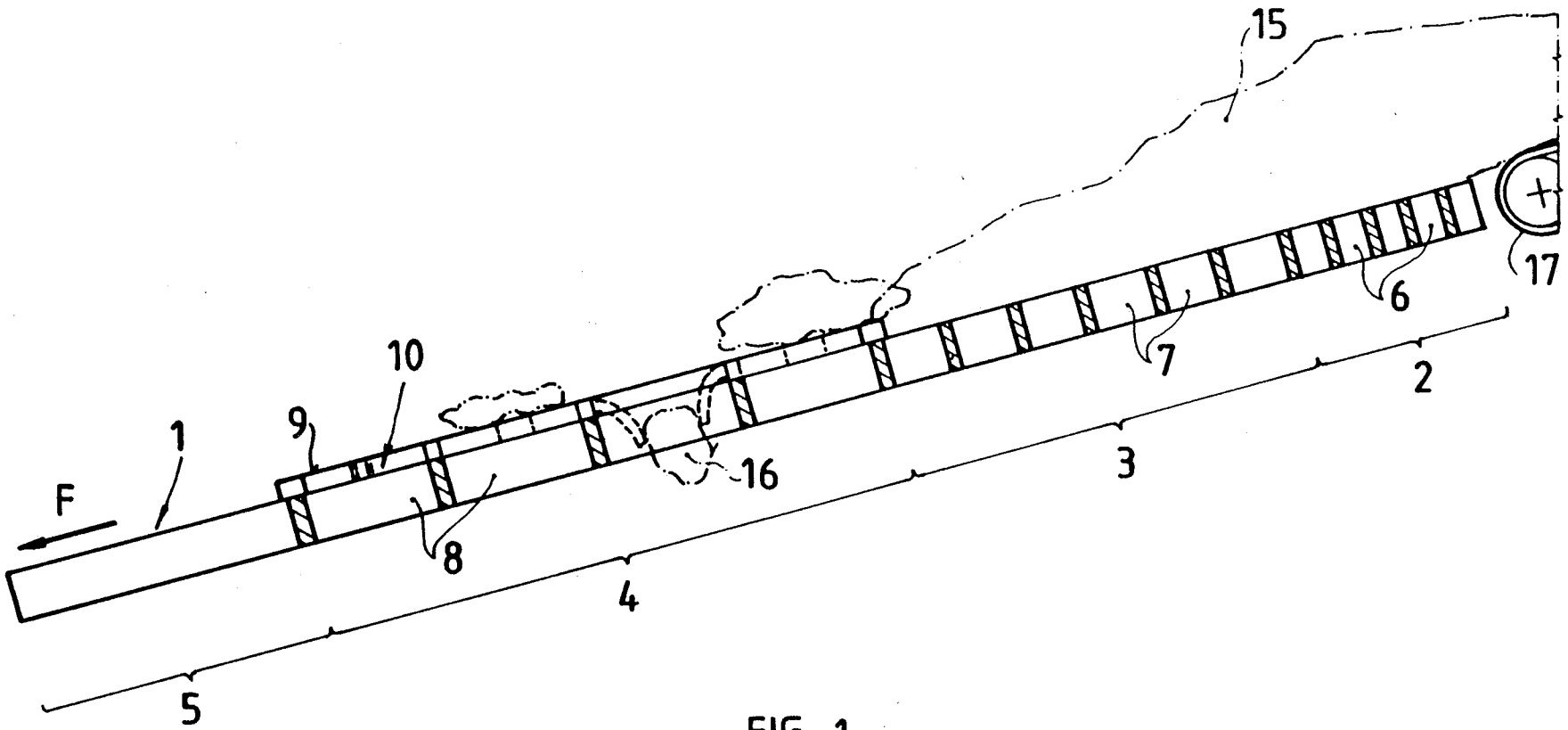
FIG. 1 shows a longitudinal section along a plate-shaped screen according to the invention.

For the sake of greater clarity, the individual drawings are not shown to scale. In FIG. 1, the reference symbol 1 denotes a metal sheet or grid screen which is subdivided into zones 2 to 5. In the zones 2 to 5 there are square orifices which are of increasing size. The zone 5 is formed from smooth sheet metal. The orifices 6 of the zone 2 have, for example, dimensions of 40×40 mm, the orifices of the zone 3 dimensions of 70×70 mm and the larger orifices 8 of the zone 4 dimensions of 150×150 mm. According to the invention, at least part of the orifices of the grid 1 of the screen is covered by elastic diaphragms 10. In the example illustrated, in the zone 4 having larger orifices 8 a plate of covering 9 made of flexible material, for example rubber, having diaphragms is provided, for example by adhesive bonding. The elastic plate could also consist of plastic, synthetic rubber, metal or elastic composite materials. The plate 9 receives the diaphragms which are formed by lamellae 10 and arranged above the associated orifices 8. The diaphragms 10 are formed by elastic lamellae 11 which are separated from one another by slits or incisions 12. In the example shown, the slits extend radially from the middle of the plate to the edges of the orifices 8 of the grid 1 located underneath. The diaphragms 10 covering the orifices 8 form screening or sifting orifices with elastically actuable orifices which are actuated as a function of the weight of the material to be sifted.

In the example illustrated, the orifices 8 have a side A of 150 mm. The lamellae 11 limit a central orifice 13 of a diameter B of 50 mm and have a constant thickness of 10 mm.

Aggregates with a grain size of a maximum of 120 mm were graded in a sifter with these dimensions. The pieces of light material present in the final product and with a maximum grain size of 70 mm could be ignored. By the use of diaphragms with lamellae of differing size, it was possible to obtain good grading results by employing rubber plates 9 with a thickness of 6 to 12 mm.

Figure 5:
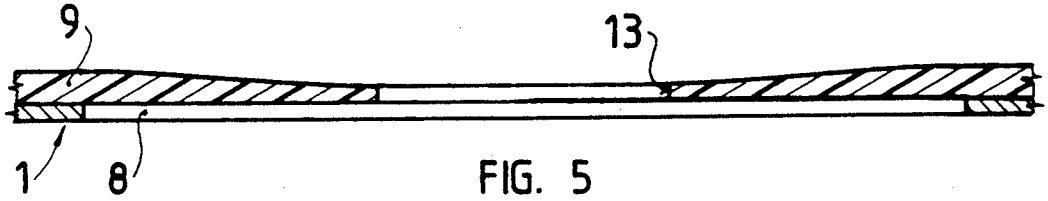
Figure 6:
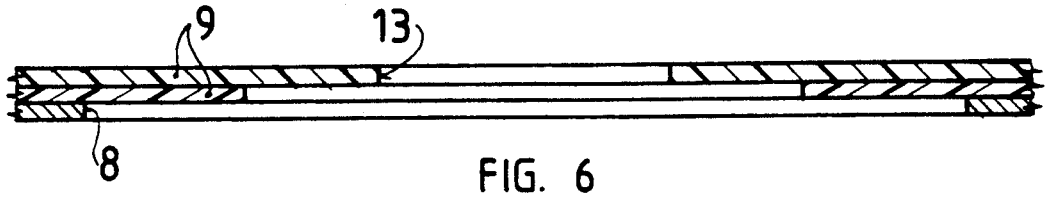
Figure 7:
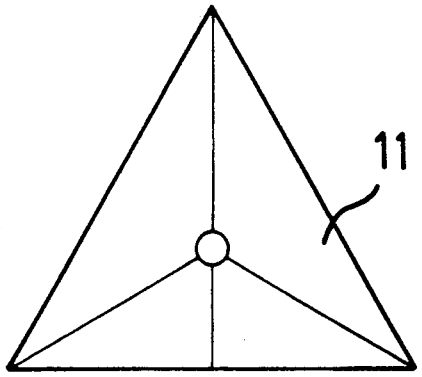
FIGS. 7 to 42 show top views of differently designed lamellae for the diaphragms.
Figure 8:
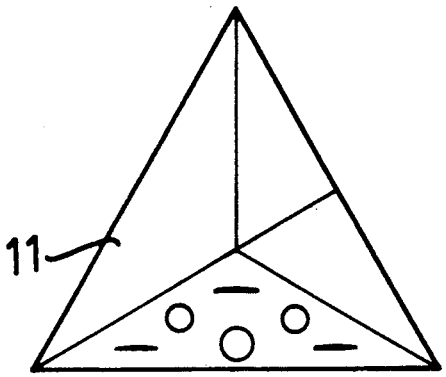
Figure 9:
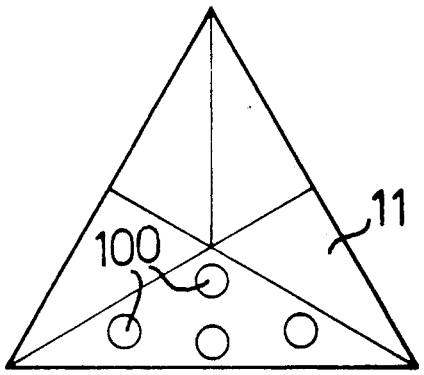
Figure 10:
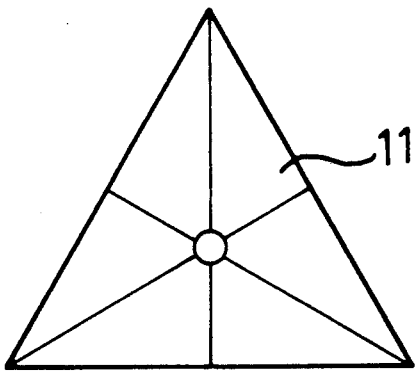
Figure 11:
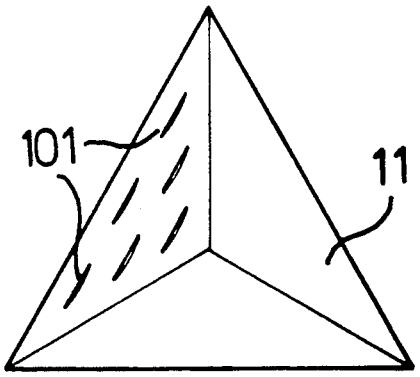
Figure 12:
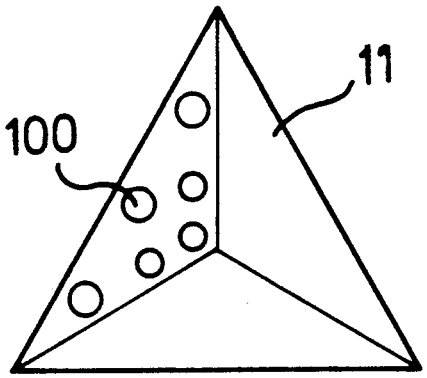
Figure 13:
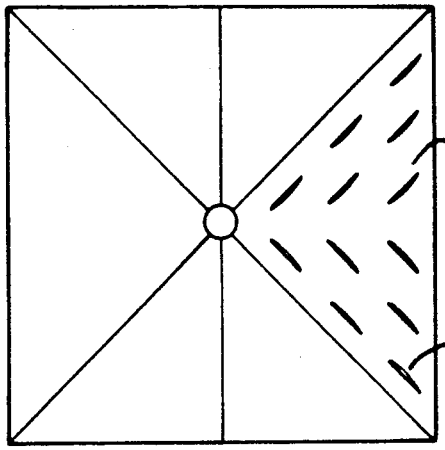
Figure 14:
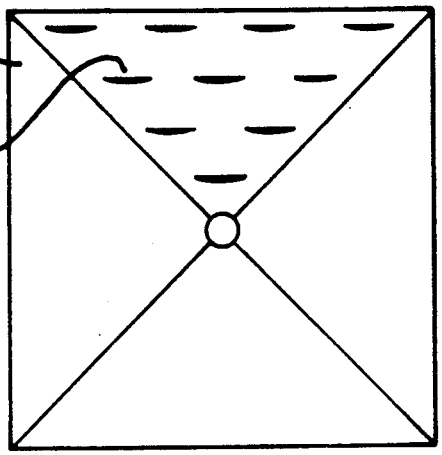
Figure 15:
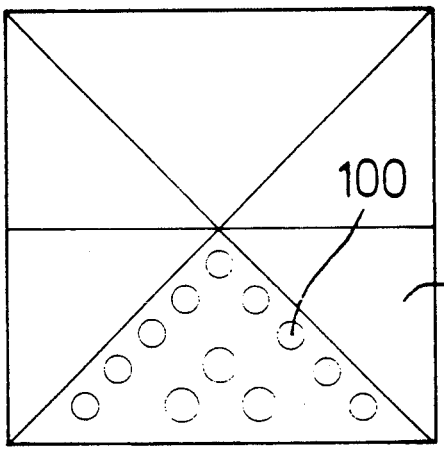
Figure 16:
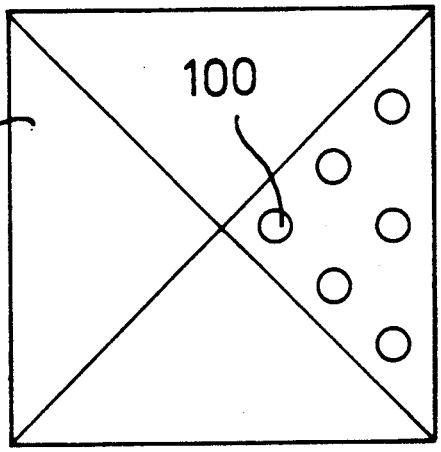
Figure 17:
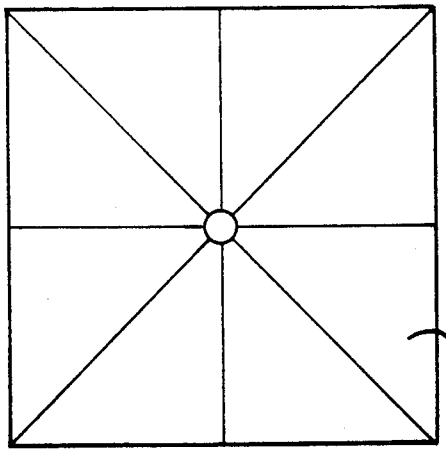
Figure 18:
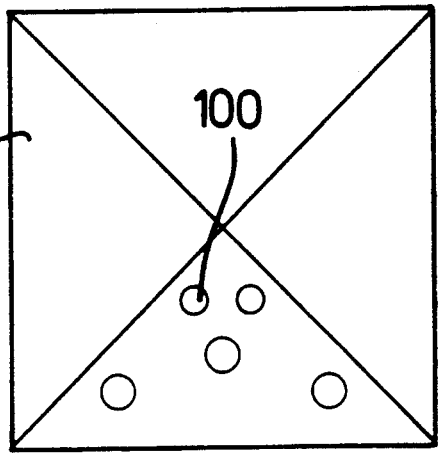
Figure 19:
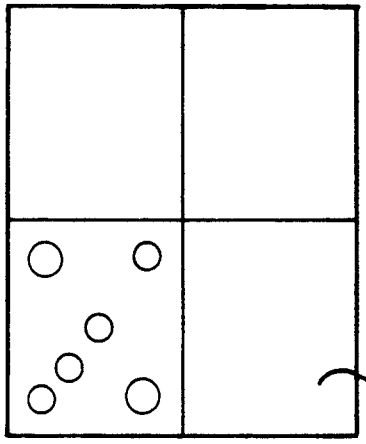
Figure 20:
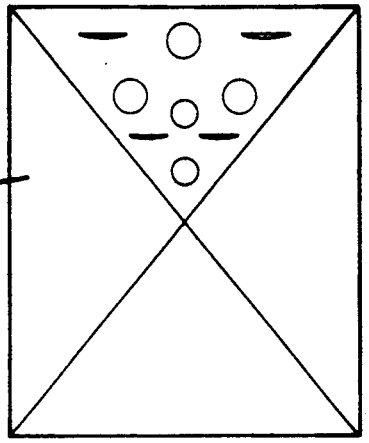
Figure 21:
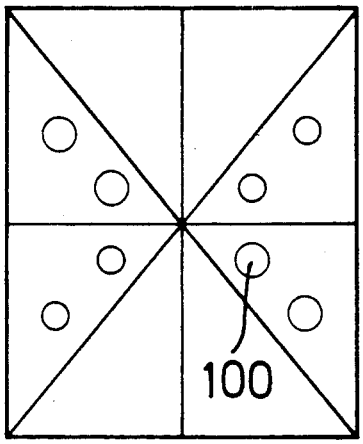
Figure 22:
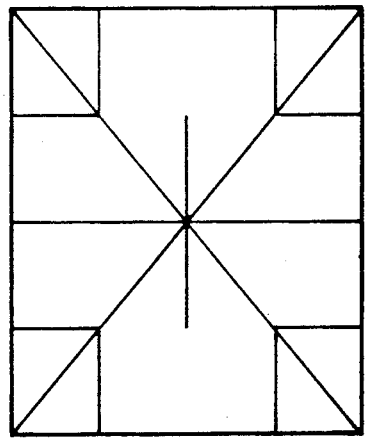
Figure 23:
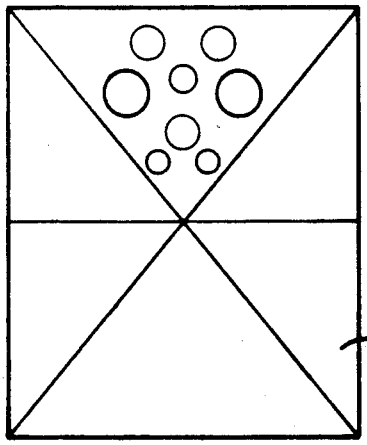
Figure 24:
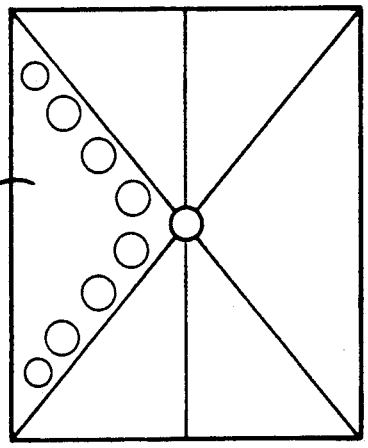
Figure 25:
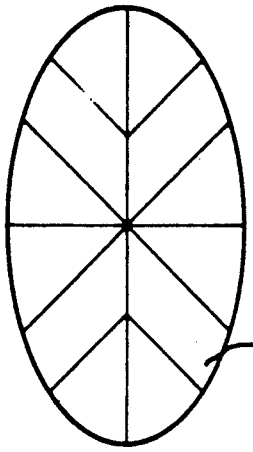
Figure 26:
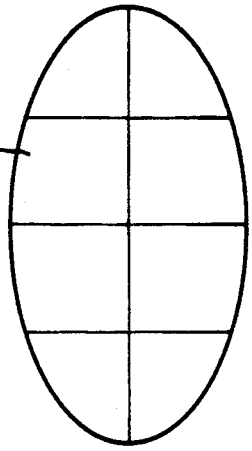
Figure 27:
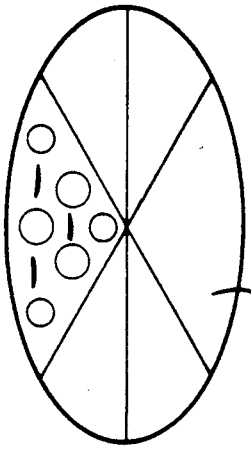
Figure 28:
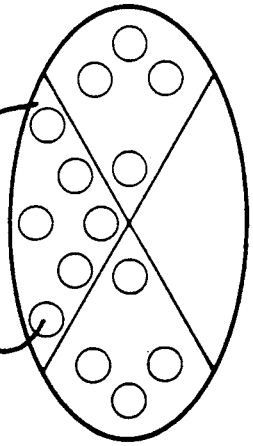
Figure 29:
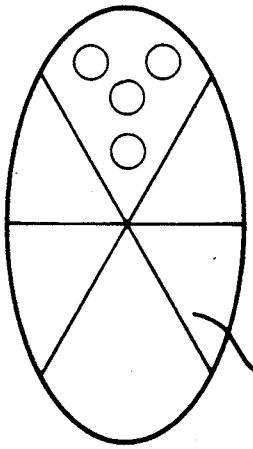
Figure 30:
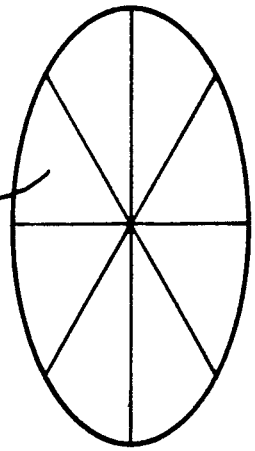
Figure 31:
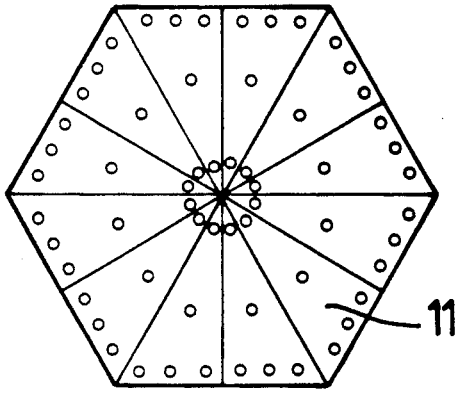
Figure 32:
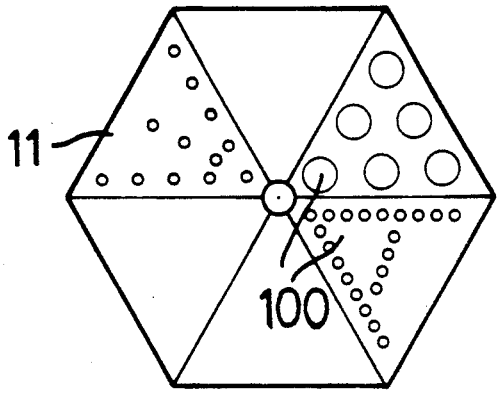
Figure 33:
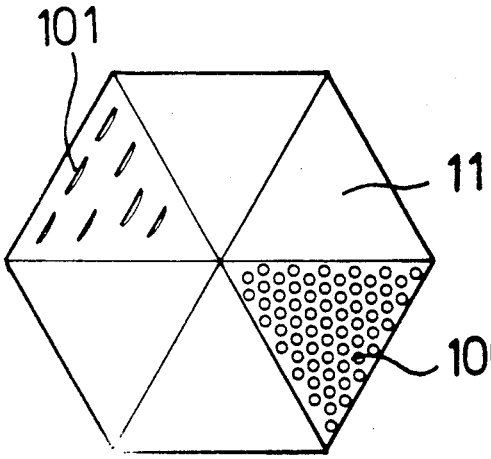
Figure 34:
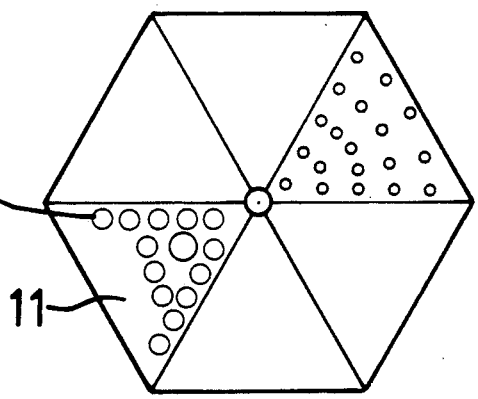
Figure 35:
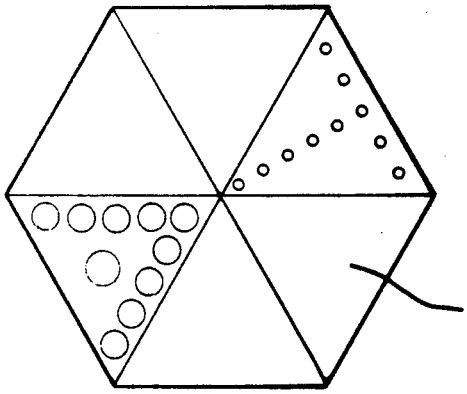
Figure 36:
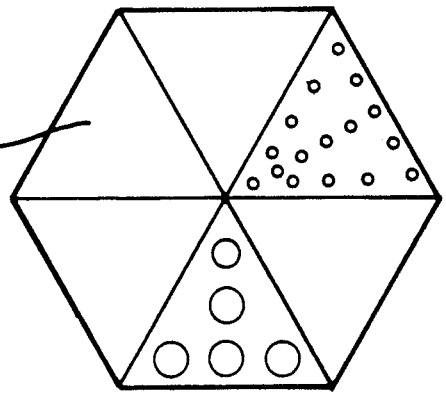
Figure 37:
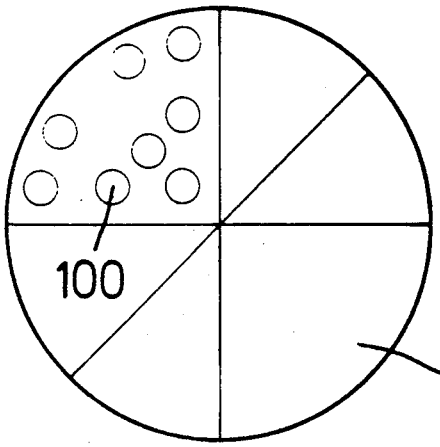
Figure 38:
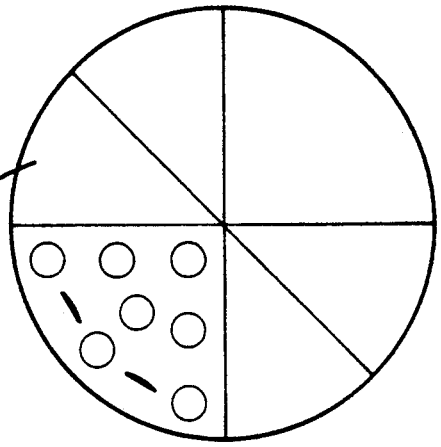
Figure 39:
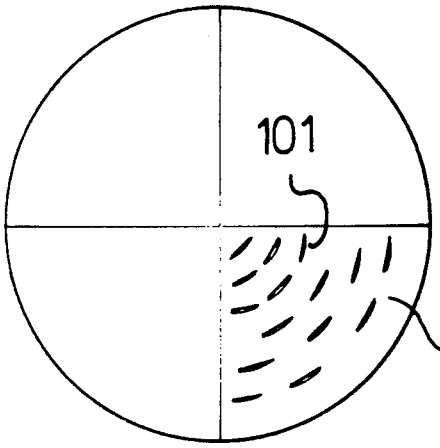
Figure 40:
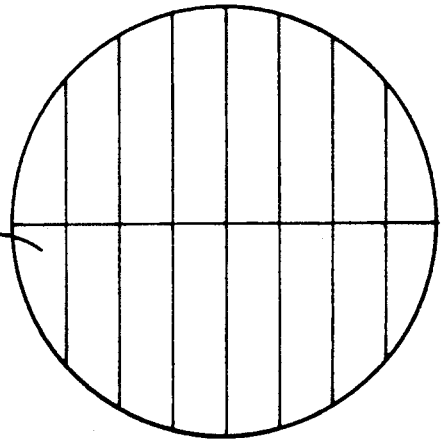
Figure 41:
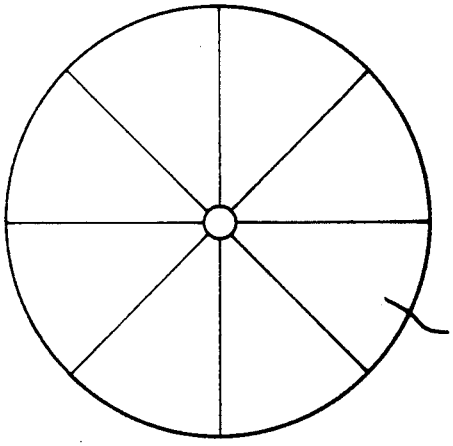
Figure 42:
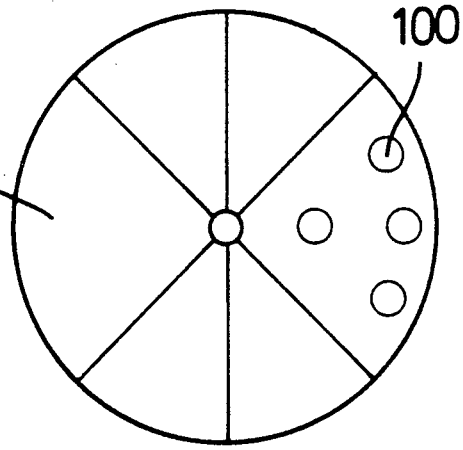

The elasticity of the lamellae can be obtained by means of different thicknesses of the lamella material, for example with a decrease in thickness of the lamellae from the inside outwards. A uniform decrease in thickness, as shown for example in FIG. 5, or a stepped decrease in thickness or the use of multilayered lamellae as shown in FIG. 6, can also be recommended.

Figure 2:
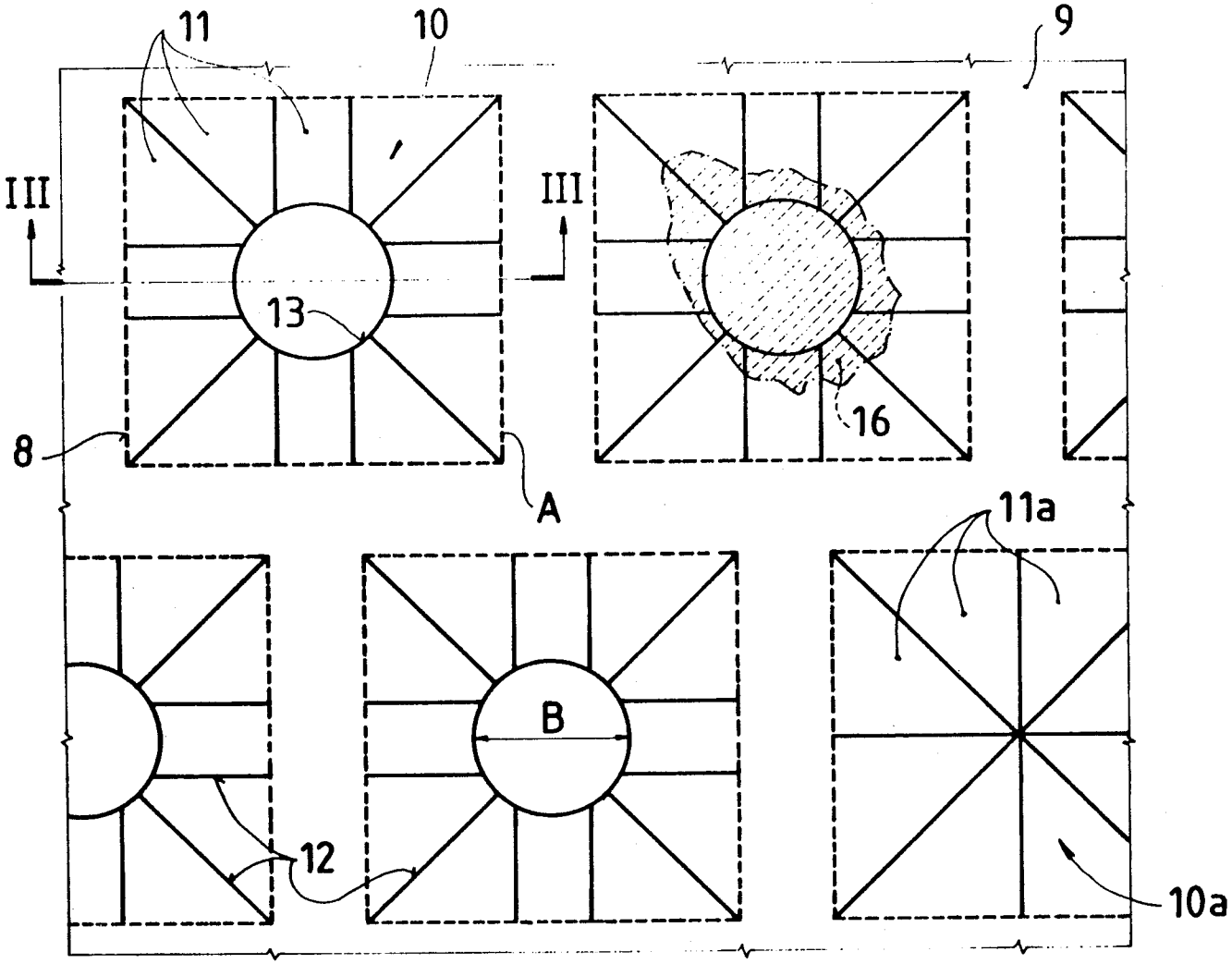
FIG. 2 shows, on an enlarged scale, a top view of a detail of the elastically designed covering for forming a lamellar diaphragm.
Figure 3:
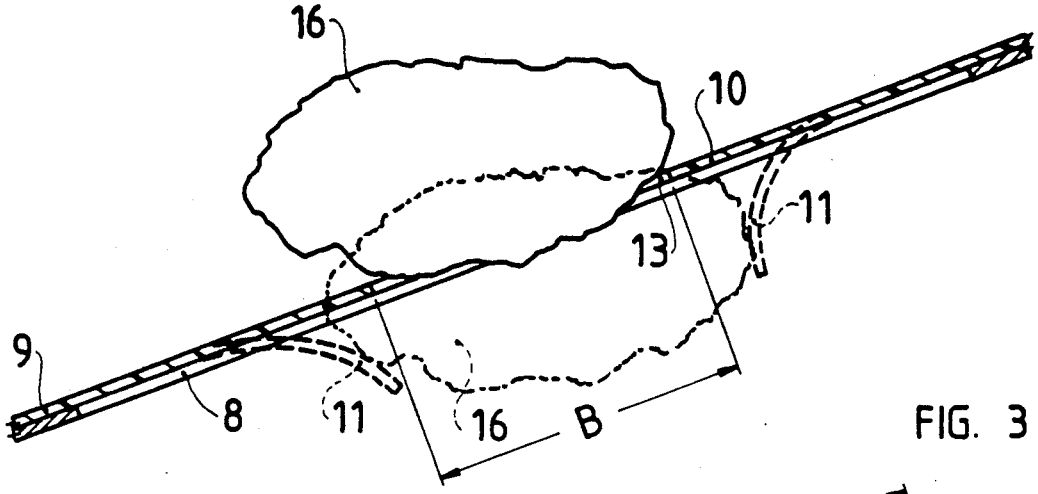
FIGS. 3 to 6 show, on an enlarges scale, a sectional representation in detail along the line III—III of FIG. 2 during the sifting operation (FIGS. 3 and 4) and in the position of rest (FIGS. 5 and 6)
Figure 4:
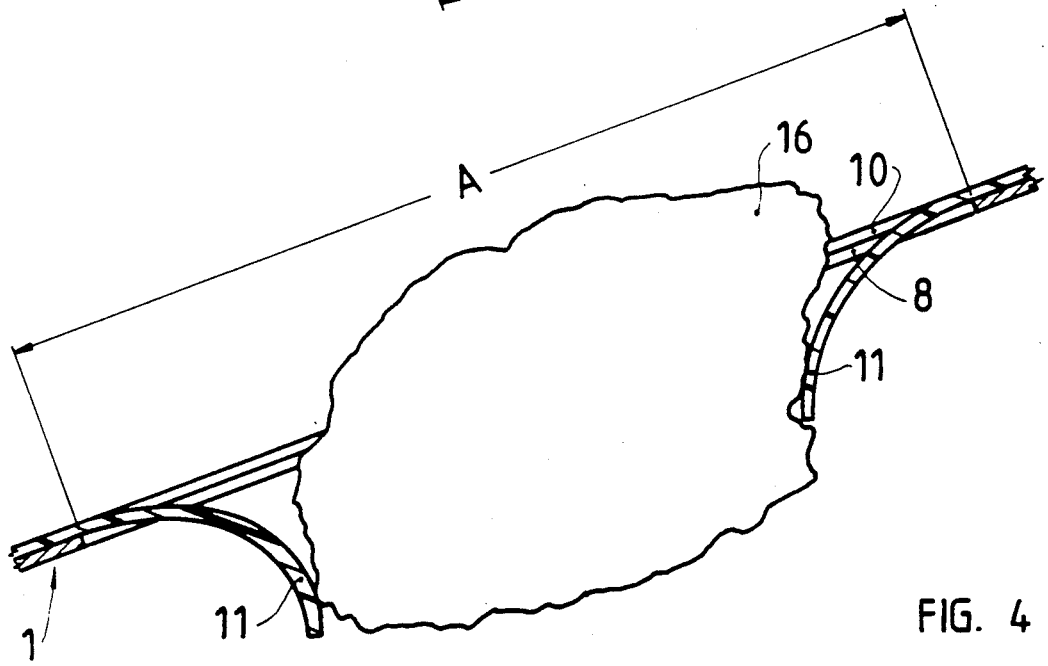

The flow 15 of previously comminuted rubble material is represented by dot-dashed lines and is supplied by a transport device 17. In FIGS. 2, 3, and 4, the pieces of rubble to be sifted are designated by the reference symbol 16. The sifting device according to the invention can also be designed as a multi-stage sifter or as a rotary screen, with the use of drilled-through or grid-like metal sheets which are arranged in one piece or in a plurality of stages. Any vibrators, which have not been shown, can be employed as accessories.

The operating mode of the sifting device according to the invention is as follows:

The smaller constituents of the building rubble to be graded, such as, for example, sand, gravel or smaller fragments, which are contained in the material flow 15 supplied, fall immediately through the orifices 6 and 7 of the sifting zones 2 and 3. The smaller constituents formed by light material also fall through these orifices. Thus, the heavier and larger constituents of the building rubble, together with large-surface, but lighter constituents constituting a large undesirable proportion of the stream of rubble, are fed to the diaphragms 10 of the plates 9. As a result of the selected dimensions of the sifting device, the heavier constituents 16 with a grain size larger than 70 mm, but smaller than 120 mm (FIGS. 3 and 4) fall through the corresponding diaphragm 10. The lamellae 11 of the diaphragm 10 are thereby deflected downwards and the corresponding heavier rubble constituents fall through the sifting device. In contrast, the larger pieces of lighter rubble slide over and beyond the preceding diaphragms 10 and move over the sifter in the direction of the arrow F.

The lighter constituents having dimensions larger than 70 mm, for example plastic constituents, as represented in FIG. 3 by a continuous line, have too low a weight to deform the lamellae 11 of the diaphragm downwards, and therefore these light constituents slide unimpeded over the diaphragms 10 and leave the sifter in the direction of the arrow F.

In the graded rubble material, the heavy separated constituents have a maximum grain size of approximately 120 mm; lighter constituents have a maximum grain size of less than 70 mm, as shown in the example. By providing at the start of the sifter sifting orifices which are smaller than the orifices of the following lamellar diaphragms, the maximum grain size for lighter materials is fixed by these lamellae.

The almost complete grading out of rubble constituents of medium and small grain size, this taking place in the zones 2 and 3 upstream of the lamellar diaphragms 10, ensures that only relatively few heavy pieces and relatively few large-surface light pieces reach the lamellar diaphragms. The return movement of the elastic lamellae 11 takes place quickly and is sufficient to execute a rapid operation to shut off the orifices 8 located underneath between the passage of two successive heavy pieces of rubble over the same diaphragm 10. Any remaining constituents of small grain size which may be present fall through the central orifices 13 of the diaphragms, without thereby causing the lamellae to open.

For an essentially complete and controlled separation of the light constituents, as shown in FIG. 2, closed diaphragms 10*a* could also be provided, that is to say diaphragms with lamellae 11*a* which cover the screening orifice completely and which have no central orifice.

It is an integral part of the abovementioned invention that the form of the central orifices 13 of the diaphragms 10 and the form, dimensions and arrangement of the orifices 8 and of the diaphragms in the various sifter stages can be any whatever. Furthermore, the diaphragms 10 could also consist of individual subassemblies formed by plates or strip-like structures which are to be attached individually to the sifter.

As can be taken from FIGS. 7 to 42, the passage orifices 8 of the sifter can have different forms.

Thus, these orifices can be made triangular, square, rectangular, oval, hexagonal or circular.

To match the elasticity of the elastic lamellae 11 to the particular requirements, these lamellae 11 are provided with circular punched-out holes 100. These punched-out holes 100 can have a constant or a variable diameter. Furthermore, the circular orifices 100 can vary in diameter, so that the elasticity and return force of the lamellae 11 are matched to the properties of the material to be sifted.

It has also proved advantageous to punch in the lamellae 11 thin slits 101, again with the object of matching the elasticity behaviour of the lamellae 11 to the requirements.

There is also the possibility of providing lamellae with circular punched-out holes 100 and with slit-like punchings 101.

I claim:

1. A sieve for sifting a flow of materials of differing weights, comprising:

(a) a screen having orifices extending through the screen and successively arranged along the flow; and (b) means responsive to the weights of the materials in the flow, for admitting entry of a material having a predetermined weight into at least one of the orifices, and for barring entry of a material having a weight less than said predetermined weight, said means including resilient diaphragms overlying at least part of said one orifice in a covering position, and yieldable under the force of said predetermined weight to an open position in which said material having said predetermined weight passes into and through said one orifice, said resilient diaphragms being self-returnable to the covering position after passage of said material having said predetermined weight.

2. The sieve according to claim 1, wherein the orifices increase in size along the flow.

3. The sieve according to claim 1, wherein the means is a plate constituted of an elastic material.

4. The sieve according to claim 3, wherein the elastic material is rubber.

5. The sieve according to claim 3, wherein said one orifice has a center and a periphery, and wherein the diaphragms overlying said one orifice extend from the periphery toward the center, each diaphragm being bounded by slits formed in the plate.

6. The sieve according to claim 5, wherein the diaphragms extend all the way to the center of said one orifice and entirely cover said one orifice in the covering position.

7. The sieve according to claim 5, wherein the diaphragms overlying said one orifice terminate short of the center and bound a central hole.

8. The sieve according to claim 5, wherein each diaphragm has a polygonal configuration.

9. The sieve according to claim 5, wherein each diaphragm has a generally circular configuration.

10. The sieve according to claim 5, wherein each diaphragm has a thickness that decreases continuously from the periphery toward the center.

11. The sieve according to claim 5, wherein each diaphragm has a thickness that decreases stepwise from the periphery toward the center.

12. The sieve according to claim 7, wherein the plate has a thickness in the range from 6 to 12 mm, and wherein the central hole has a diameter in the range from 30 to 60 mm.

13. The sieve according to claim 1; and further comprising means for adjusting the resilience of the diaphragms, including forming a number of openings through each diaphragm.

14. The sieve according to claim 2, wherein the orifices include largest orifices, and wherein said one orifice is one of the largest orifices.

15. The sieve according to claim 3, wherein the plate is mounted on the screen and overlies multiple orifices in the screen.

16. The sieve according to claim 1, wherein each diaphragm is flexible and lamellar.

17. The sieve according to claim 1, wherein the materials are comminuted building rubble.

* * * * *